US009959828B2

(12) United States Patent
Lee et al.

(10) Patent No.: US 9,959,828 B2
(45) Date of Patent: May 1, 2018

(54) METHOD AND APPARATUS FOR DRIVING DISPLAY PANELS DURING DISPLAY-OFF PERIODS

(71) Applicant: Solomon Systech Limited, Hong Kong (HK)

(72) Inventors: Cheung Fai Lee, Hong Kong (HK); Jun Chen, Hong Kong (HK); Hongyi Qian, Singapore (SG)

(73) Assignee: Solomon Systech Limited, Hong Kong (HK)

( * ) Notice: Subject to any disclaimer, the term of this patent is extended or adjusted under 35 U.S.C. 154(b) by 136 days.

(21) Appl. No.: 15/253,730

(22) Filed: Aug. 31, 2016

(65) Prior Publication Data

US 2018/0061338 A1 Mar. 1, 2018

(51) Int. Cl.
*G09G 3/36* (2006.01)

(52) U.S. Cl.
CPC ... *G09G 3/3648* (2013.01); *G09G 2300/0426* (2013.01); *G09G 2310/08* (2013.01)

(58) Field of Classification Search
None
See application file for complete search history.

(56) References Cited

U.S. PATENT DOCUMENTS 8,970,577 B2 3/2015 Lillie et al.
9,280,231 B2 3/2016 Small et al.
2006/0274011 A1* 12/2006 Igarashi ..... G09G 3/3648 345/94
2011/0175898 A1* 7/2011 Yen ..... G09G 3/3648 345/214
2012/0162134 A1* 6/2012 Chen ..... G06F 3/044 345/174
2015/0049071 A1* 2/2015 Kaneko ..... G09G 3/3648 345/211
2015/0332651 A1* 11/2015 Miyazawa ..... G09G 3/3614 345/211

* cited by examiner

*Primary Examiner* — Nicholas J Lee
*Assistant Examiner* — Duane N Taylor, Jr.
(74) *Attorney, Agent, or Firm* — Spruson & Ferguson (Hong Kong) Limited

(57) ABSTRACT

A method for driving a thin film transistor (TFT) liquid crystal display (LCD) panel during a display-off period is provided for avoiding image flickering when the panel resumes image display. Flickering when resuming image display is due to charge accumulated on liquid crystals (LCs) during the display-off period. For a cell having a TFT and a LC, the method releases the accumulated charge by driving a gate electrode with a VGH voltage to turn on the TFT for a short pre-determined duration regularly over the display-off period. Over the pre-determined duration, a VCOM electrode and a source electrode of the cell are also driven with a GND voltage, thereby releasing the accumulated charge from the LC as the TFT is turned on. The remaining time in the display-off period may be advantageously used for touch sensing while avoiding flickering after image display is resumed.

20 Claims, 5 Drawing Sheets

METHOD AND APPARATUS FOR DRIVING DISPLAY PANELS DURING DISPLAY-OFF PERIODS

FIELD OF THE INVENTION

The present invention generally relates to driving a thin film transistor (TFT) liquid crystal display (LCD) panel. In particular, the present invention relates to driving the TFT LCD panel during a display-off period in order to avoid image flickering when the panel leaves the display-off period.

BACKGROUND

TFT LCD panels are often employed in portable consumer-electronics devices, such as smartphones, as displays. To save battery power, these devices are usually programmed to turn off the panels when the users are not using the devices. However, it is observed that when a TFT LCD panel resumes displaying an image from a display-off mode, the resumed picture displayed on the panel may flicker. The occurrence of flickering is especially noticeable if the panel has been stayed in the display-off mode for a long time. The occurrence of flickering is negative to user experience. Furthermore, many portable consumer-electronics devices are equipped with a "knock-on" feature. By the knock-on feature, a portable device originally having its touch-sensing-enabled LCD panel turned off for saving power is waken up to resume image display when a user knocks on the panel. The noticeable flicker is highly undesirable to positive user experience when the knock-on feature is used. There is a need in the art for a technique to avoid or minimize flickering when the TFT LCD panel resumes image displaying from the display-off mode.

SUMMARY OF THE INVENTION

A first aspect of the present invention is to provide a method for driving a TFT LCD panel during a display-off period. The panel comprises plural cells. Each of the cells has a TFT for driving a liquid crystal (LC), a gate electrode coupled to a gate of the TFT, a source electrode coupled to one end of the LC via the TFT, and a VCOM electrode coupled to another end of the LC. The method comprises the following steps:

1. When the display-off period begins, the gate electrode, the source electrode and the VCOM electrode are driven in order to configure the panel to be black for a first pre-determined duration unless such configuring of the panel is prematurely terminated by a termination of the display-off period.
2. When the first pre-determined duration expires, the gate electrode is driven with a VGH voltage to turn on the TFT for a second pre-determined duration.
3. Over the second pre-determined duration within which the gate electrode is driven with the VGH voltage in the step 2, the source electrode and the VCOM electrode are driven with the GND voltage, whereby charge accumulated on the LC is released.
4. When the second pre-determined duration expires, the gate electrode, the source electrode and the VCOM electrode are driven to again configure, the panel to be black for the first pre-determined duration unless such configuring of the panel is prematurely terminated by the termination of the display-off period.

6. Repeat the steps 2-4 until the display-off period expires or the termination of the display-off period occurs.

In case the panel supports touch sensing so that the VCOM electrode is also an in-cell sensor electrode, the method may further comprise, in the steps 1 and 4, driving the gate electrode, the source electrode and the in-cell sensor electrode to further configure the panel to perform touch sensing while maintaining the panel to be black. To enable touch sensing and keep the panel black at the same time, one practical approach is to drive the gate electrode with a VGL voltage such that the TFT is turned off, and to drive the in-cell sensor electrode with a toggling waveform. In one option, the termination of the display-off period is triggered when a touch on the panel is sensed.

A second aspect of the present invention is to provide a method for driving the TFT LCD panel during a time period between an end of a first display-on period and a beginning of a second display-on period. The first and second display-on periods are successive display-on periods with the display-off period in between.

The method comprises driving the panel during the display-off period according to any embodiment disclosed in the first aspect of the present invention. The method further comprises: driving the panel during a first transition period bounded by the end of the first display-on period and a beginning of the display-off period; and driving the panel during a second transition period bounded by an end of the display-off period and the beginning of the second display-on period.

In driving the panel during the first transition period, the source electrode and the VCOM electrode are driven with the GND voltage during a rear part of the first transition period, wherein the first transition period is divided into a front part and the rear part. The front part and the rear part of the first transition period are adjacent to the first display-on period and the display-off period, respectively.

In driving the panel during the second transition period, the source electrode and the VCOM electrode are driven with the GND voltage during a front part of the second transition period, wherein the second transition period is divided into the front part and a rear part. The front part and the rear part of the second transition period are adjacent to the display-off period and the second display-on period, respectively.

During the first and second transition periods, the gate electrode is driven according to a scanning scheme used for driving the gate electrode in the first and second display-on periods.

During the front part of the first transition period, preferably the source electrode is driven with a +VL voltage generated by a positive source buffer or driven with a −VL voltage generated by a negative source buffer as well as the VCOM electrode is driven with a VCOM_display voltage. The VCOM_display voltage is a voltage used to drive the VCOM electrode during the first and second display-on periods. For a normally black panel, which displays relatively dark brightness when the voltage difference between the source electrode and the VCOM electrode is relatively small, the +VL voltage and the −VL voltage are a positive voltage and a negative voltage, respectively, closest to the VCOM_display voltage among all pre-defined allowable voltages supplied to the source electrode during the first and second display-on periods. It is opposite for a normally white panel, which displays with greater brightness when the voltage difference between the source electrode and the VCOM electrode is smaller. In this case, the +VL voltage and the −VL voltage are a positive voltage and a negative voltage, respectively, farthest to the VCOM_display voltage among all the pre-defined allowable voltages supplied to the source electrode during the first and second display-on periods.

During the rear part of the second transition period, preferably the source electrode is driven with the +VL voltage or with the −VL voltage while the VCOM electrode is driven with the VCOM_display voltage.

A third aspect of the present invention is to provide an apparatus for driving the TFT LCD panel. The apparatus comprises one or more drivers configured to drive the gate electrode, the source electrode and the VCOM electrode (or the VCOM/in-cell sensor electrode) according to any of the embodiments in the first or second aspect of the present invention.

Other aspects of the present invention are disclosed as illustrated by the embodiments hereinafter.

DETAILED DESCRIPTION

The following definitions are used herein in the specification and the appended claims. "A display-off period" means a time period within which a TFT LCD panel is configured or controlled to not display an image thereon even if the panel receives an external signal containing image data. In most cases, the panel turns black (or blank) during the display-off period. "A display-on period" means a time period within which a TFT LCD panel is configured or controlled to allow an image to be displayed on the panel. "A GND voltage" means a reference voltage, usually denoted as a ground voltage, on which other voltage levels are referenced to. In many circuit designs, the GND voltage is assigned as a voltage with zero volt. "A VCOM_display voltage" means a substantially-stable voltage used to drive a VCOM electrode (see below for explanation) of a display element (i.e. a cell) in a TFT LCD panel when the panel is configured for image displaying without touch sensing. "A VGH voltage" means a voltage that turns on a TFT of a TFT LCD panel, and "a VGL voltage" means another voltage that turns off the TFT.

The present invention is concerned with driving a TFT LCD panel. Although the present invention is advantageously useful for the panel that supports touch sensing, the present invention is not limited only for a touch-sensing-enabled TFT LCD panel. The present invention is also useful for a TFT LCD panel without touch-sensing capability.

Figure 1:
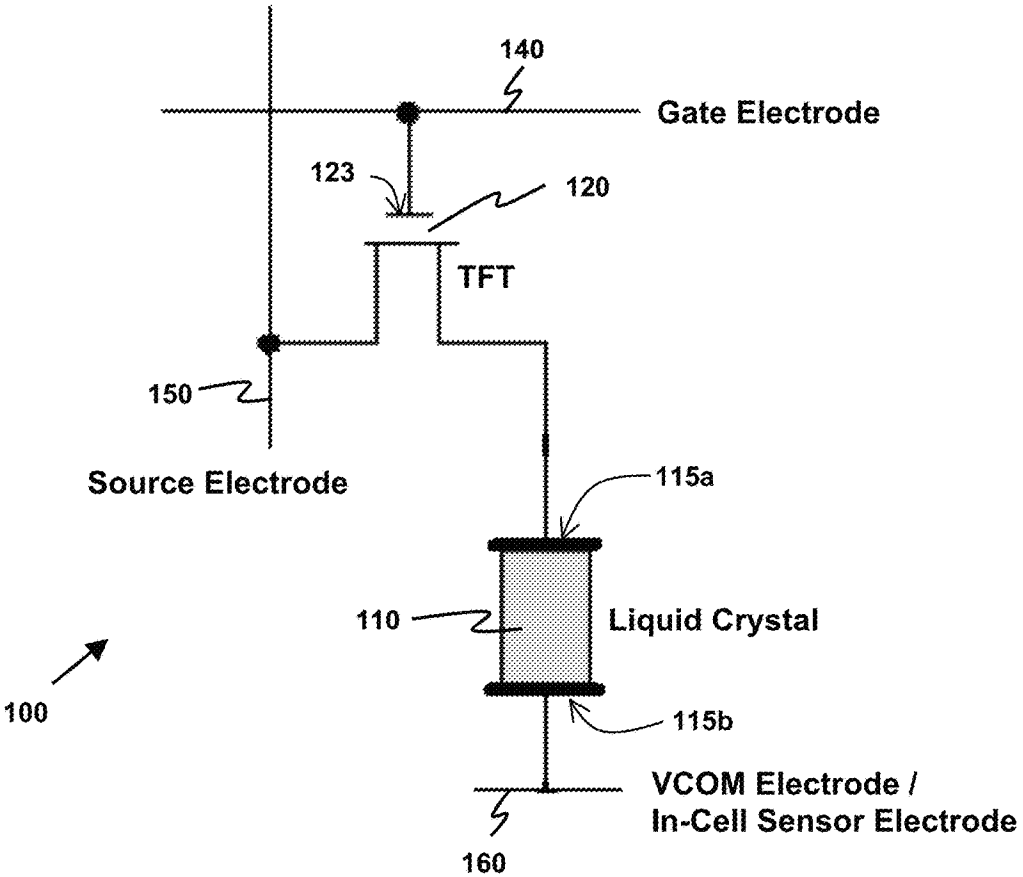
FIG. 1 (Related Art)
FIG. 1 depicts a typical example of a cell or a display element in a TFT LCD panel for illustrating the structure of the cell.

The TFT LCD panel comprises display elements commonly known as cells. The cells are usually arranged as a rectangular array. FIG. 1 depicts a typical example of the cell for illustrating the structure thereof. A cell 100 comprises a TFT 120 for driving a LC 110, a gate electrode 140 coupled to a gate 123 of the TFT 120, a source electrode 150 coupled to one end 115*a* of the LC 110 via the TFT 120, a VCOM electrode 160 coupled to another end 115*b* of the LC 110. If the cell 100 is configured for touch sensing, the VCOM electrode 160 is also an in-cell sensor electrode (hereinafter denoted as a VCOM/in-cell sensor electrode 160 for convenience). Examples of signal waveforms for driving gate electrodes, source electrodes and VCOM/in-cell sensor electrodes for an array of cells in a TFT LCD panel can be found in, e.g., U.S. patent application Ser. No. 14/807,894, the disclosure of which is incorporated by reference herein.

In a TFT LCD panel, the cells are usually substantially similar. It follows that one signal waveform that is designed can be used to drive electrodes of the same type for all cells. For example, a signal waveform for driving the gate electrode of one cell is also usable for driving the gate electrode of another cell. The present invention is hereinafter illustrated by describing exemplary signal waveforms for driving the electrodes 140, 150, 160 of the cell 100.

The Inventors have made the following observations that lead to the present invention. For a knock-on feature implemented on a TFT LCD panel that supports touch sensing, the touch-sensing function of the panel is kept alive when the panel enters into a display-off period. During the display-off period, it is required to provide a toggling waveform to a VCOM/in-cell sensor electrode for a cell in order to enable touch sensing (as explained in the U.S. patent application Ser. No. 14/807,894). The toggling of the waveform may trigger accumulation of charge on the LC of the cell through parasitic coupling. After a long duration of display off while keeping touch sensing, the charge may be built up on the LC. When the panel leaves the display-off period and resumes image displaying, the accumulated charge on the LC may cause flickering. Therefore, it is advantageous if the accumulation of charge on the LC is prevented or minimized by periodically releasing the accumulated charge over the display-off period.

Figure 5:
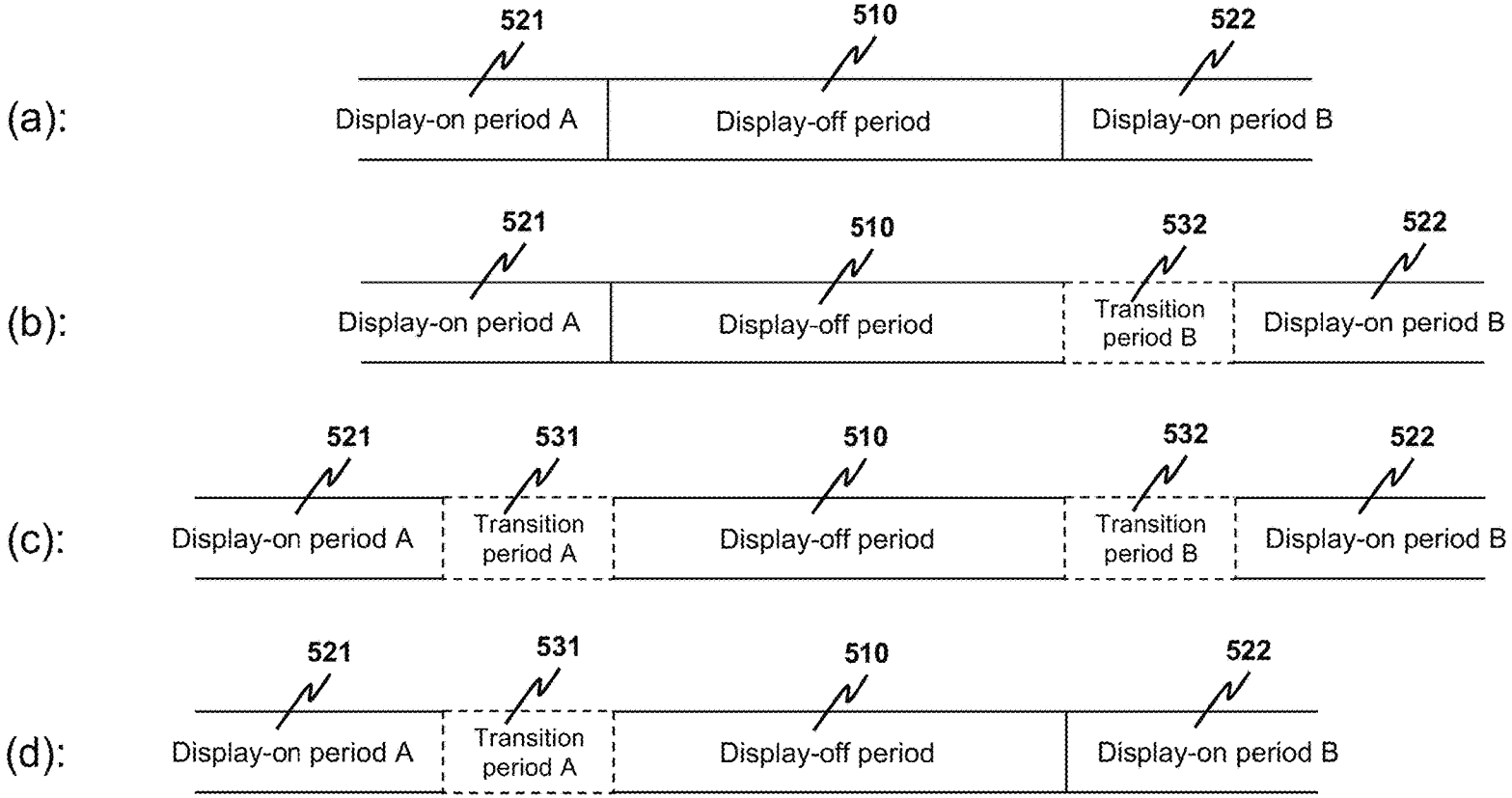
FIG. 5 depicts the four cases of arranging a display-off period between two successive display-on periods.

The display-off period is situated between two successive display-on periods. FIG. 5 depicts different cases, respectively denoted as cases (a)-(d), of arranging the display-off period between the two successive display-on periods. In case (a), a display-off period 510 is time-bounded by a display-on period A 521 and a display-on period B 522. As depicted in case (b), it is preferable to insert a transition period B 532 between the display-off period 510 and the display-on period B 522 to ensure smooth transition from display-off to display-on. In addition to adding the transition period B 532, advantageously it is also preferable to further insert a transition period A 531 between the display-on period A 521 and the display-off period 510 for ensuring smooth transition from display-on to display-off, as shown in case (c). For completeness, case (d) depicts an option that only the transition period A 531 is added between the display-on period A 521 and the display-off period 510.

Figure 2:
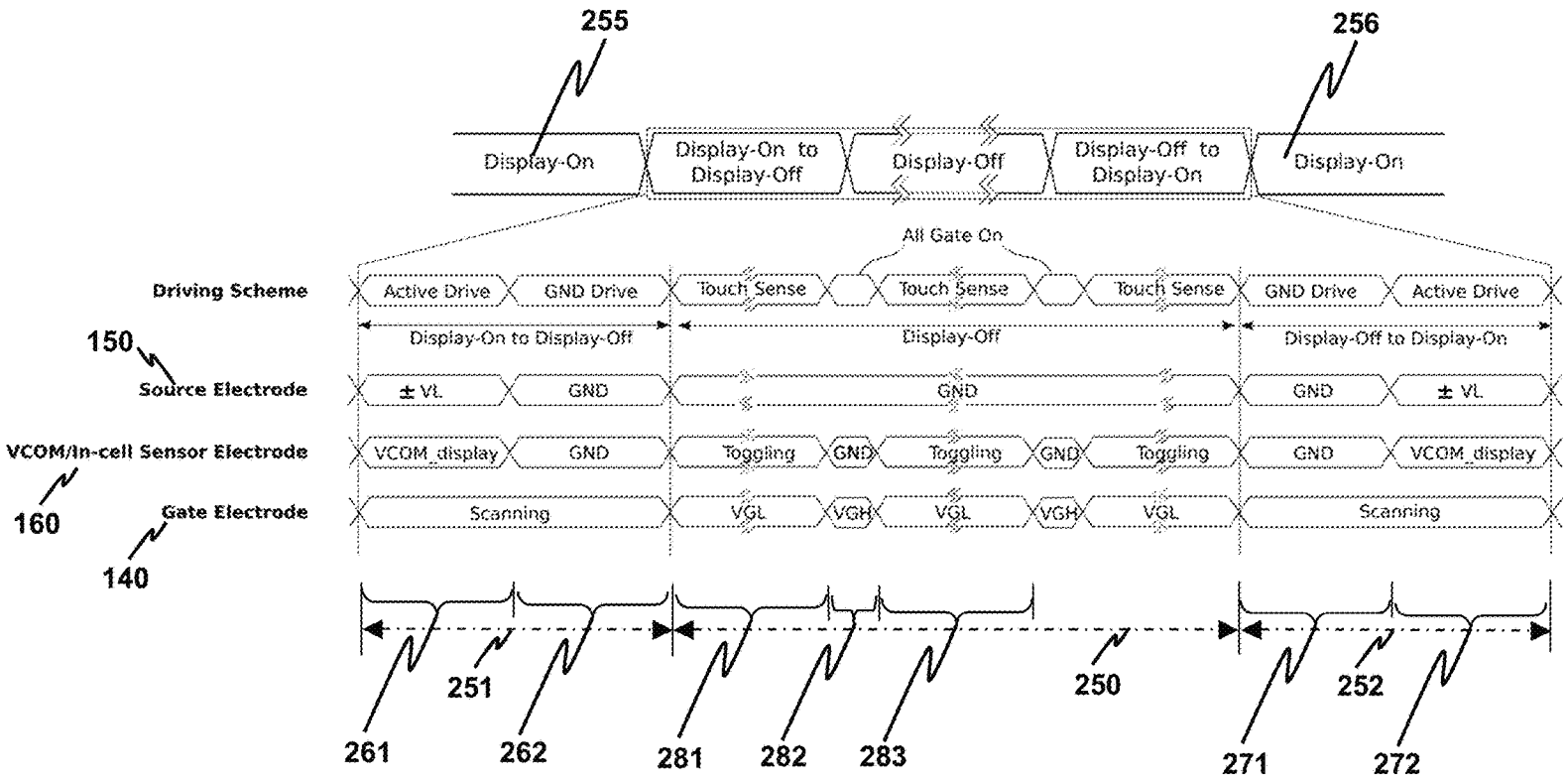
FIG. 2 is a signal diagram depicting signals supplied to a gate electrode, a source electrode and a VCOM/in-cell sensor electrode for the cell of the panel in accordance with an exemplary embodiment of the present invention, where the panel supports touch sensing and touch sensing is performed during a display-off period.
Figure 3:
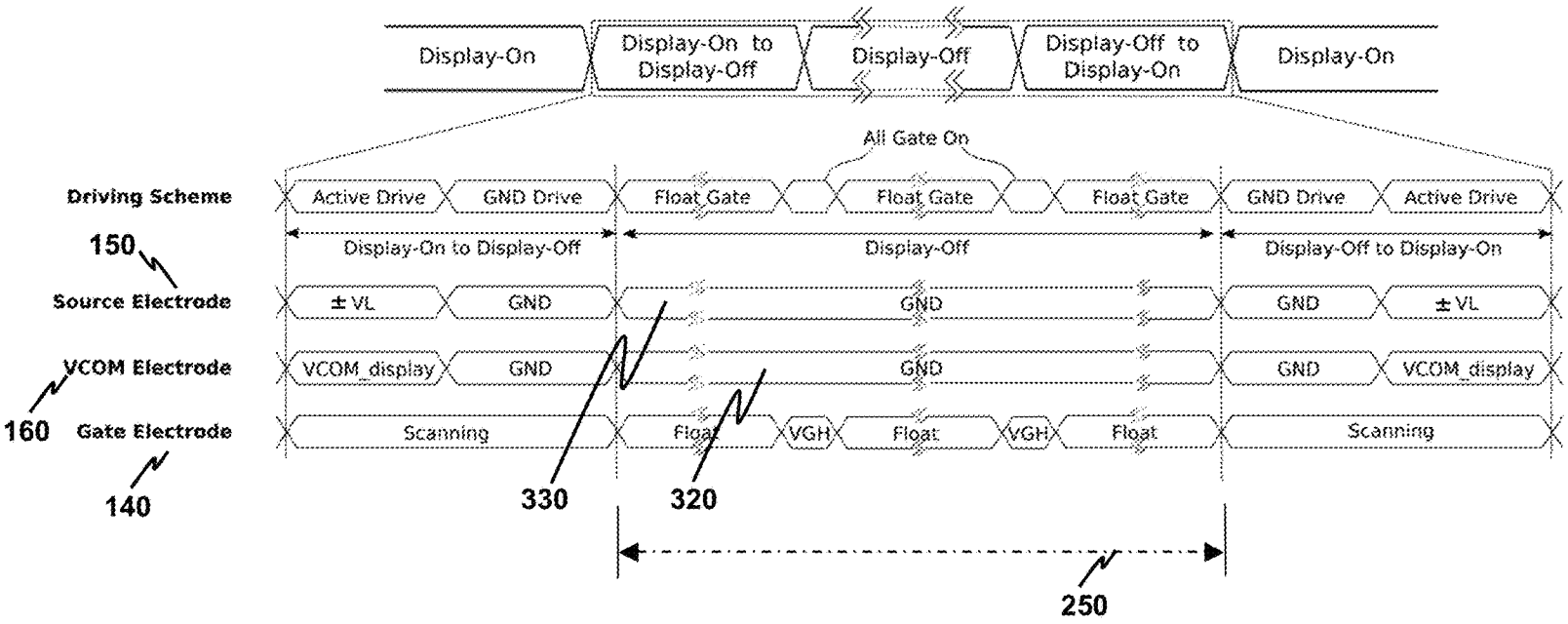
FIG. 3 is a signal diagram similar to FIG. 2 except that the panel does not support touch sensing or touch sensing is not performed during the display-off period.

The present invention provides signal waveforms for driving the electrodes 140, 150, 160 for the time period between the two successive display-on periods 521, 522. Exemplarily, the present invention is to be illustrated with the aid of FIGS. 2 and 3. Although FIGS. 2 and 3 depict the signal waveforms for the case (c) only, it is understood that the present invention cover cases (a)-(d) as shown in FIG. 5. Those skilled in the art can easily derive the signal waveforms for cases (a)-(b) and (d) from the teachings disclosed hereinafter based on case (c).

FIG. 2 is a signal diagram depicting signals supplied to the gate electrode 140, the source electrode 150 and the VCOM/in-cell sensor electrode 160 for the cell 100 in a panel, where the panel supports touch sensing. Along the time axis, there are a first display-on period 255 and a second display-on period 256, both of which are successive display-on periods. A display-off period 250 is situated in between the two display-on periods 255, 256. There are also a first transition period 251 for transiting from display-on to display-off, and a second transition period 252 for transiting from display-off to display-on. The first transition period 251 is bounded by an end of the first display-on period 255 and a beginning of the display-off period 250. The second transition period 252 is bounded by an end of the display-off period 250 and a beginning of the second display-on period 256. FIG. 3 is similar to FIG. 2 but touch sensing is not performed during the display-off period 250. Not performing touch sensing may be because the panel does not support touch sensing at all, or touch sensing is not scheduled.

A first aspect of the present invention is to provide a method for driving a TFT LCD panel during the display-off period 250.

Refer to FIG. 2 and consider the display-off period 250. When the display-off period 250 begins, the panel (or the cell 100) enters into a first touch-sensing period 281 within which touch sensing is enabled. The first touch-sensing period 281 occupies a first pre-determined duration in time unless this period 281 is prematurely terminated. The first pre-determined duration may be selected from milliseconds to hours, as the display-off period 250 can be short or long depending on user operation. During the first touch-sensing period 281, the gate electrode 140, the source electrode 150 and the VCOM/in-cell sensor electrode 160 are driven to configure the panel to perform touch sensing while maintaining the panel to be black. There are different driving arrangements for the aforementioned electrodes 140, 150, 160 for enabling touch sensing and at the same time, keeping the panel to be black. In one embodiment, the VCOM/in-cell sensor electrode 160 is driven with a toggling waveform to enable touch sensing during the first touch-sensing period 281. During the first touch-sensing period 281, the gate electrode 140 is driven with a VGL voltage in order to turn off the TFT 120 for the first pre-determined duration, so that the source electrode 150 is disconnected from the LC 110 to thereby maintain the panel to be black. Such blackening of the panel may be prematurely terminated by a termination of the display-off period 250. As an example, the termination of the display-off period 250 is triggered when the knock-on feature is active and a touch, or a click, produced by a user is sensed on the panel. The premature termination of such panel blackening also means that the first touch-sensing period 281 is prematurely terminated and hence has a duration less than the first pre-determined duration.

When the first pre-determined duration expires, the panel (or the cell 100) enters into a charge-release phase 282. The charge-release phase 282 occupies a second pre-determined duration in time. During the whole charge-release phase 282, the gate electrode 140 is driven with a VGH voltage to turn on the TFT 120, and the source electrode 150 and the VCOM/in-cell sensor electrode 160 are driven with the GND voltage, or in general a certain reference voltage. The turning-on of the TFT 120 enables the source electrode 150 to be coupled to the LC 110. Since both the source electrode 150 and the VCOM/in-cell sensor electrode 160 are driven with the GND voltage, the two ends 115*a*, 115*b* of the LC 110 are equalized in voltage. It follows that the possible charge on the LC 110 is released, thereby preventing charge accumulation on the LC 110. Since the accumulated charge is quickly released once the two ends 115*a*, 115*b* are equalized, the second pre-determined duration only needs to be a short period. Preferably, the second pre-determined duration is selected to be substantially shorter than the first pre-determined duration. In one practical option, the second pre-determined duration is selected to be a duration of one image frame. The duration of one image frame is related to a refresh rate of the panel. If the refresh rate takes a practical value of 60 Hz, the duration of one image frame is calculated to be 1/60 second or 16.6 ms.

When the charge-release phase 282 ends, the panel (or the cell 100) enters into a second touch-sensing period 283. The second touch-sensing period 283 occupies the first pre-determined duration in time unless it is prematurely terminated. Similar to the first touch-sensing period 281, during the second touch-sensing period 283, the gate electrode 140, the source electrode 150 and the VCOM/in-cell sensor electrode 160 are driven to configure the panel to perform touch sensing while maintaining the panel to be black. In one embodiment, the VCOM/in-cell sensor electrode 160 is driven with the toggling waveform to enable touch sensing and the gate electrode 140 is driven with the VGL voltage to turn off the TFT 120 unless the second touch-sensing period 283 is prematurely terminated by the termination of the display-off period 250.

The charge-release phase 282 and the second touch-sensing period 283 are one-by-one cyclically repeated until the display-off period 250 expires as scheduled or the termination of the display-off period 250 occurs.

In one embodiment, the TFT 120 is turned off during the first and second touch-sensing periods 281, 283 by simply floating the gate electrode 140 instead of driving the gate electrode 140 with the VGL voltage. In another embodiment, the source electrode 150 may be continuously driven with the GND voltage during the entire display-off period 250.

Refer to FIG. 3. When touch sensing is not performed during the display-off period 250, both the source electrode 150 and the VCOM electrode 160 are driven with the GND voltage (respectively indicated as 330 and 320) over the display-off period 250. Since the two electrodes 150, 160 are driven with the same direct-current (DC) voltage, it has an advantage that the LC 110 is prevented from stressing by a DC component or accumulating charge under an alternating-current (AC) component.

A second aspect of the present invention is to provide a method for driving the TFT LCD panel during a time period between the end of the first display-on period 255 and the beginning of the second display-on period 256. In this method, the driving of the gate electrode 140, the source electrode 150 and the VCOM/in-cell sensor electrode 160 during the display-off period 250 follows any embodiment disclosed according to the first aspect of the present invention. Furthermore, signal waveforms used for driving these electrodes 140, 150, 160 during the first transition period 251 and the second transition period 252 are tailored so as to provide smooth transitions from display-on to display-off and vice versa.

FIG. 2 depicts one embodiment of driving the panel during the first transition period 251 and the second transition period 252. Consider the signal waveforms during the first transition period 251. The first transition period 251 is divided into a front part 261 and a rear part 262. The front part 261 and the rear part 262 are adjacent to the first display-on period 255 and the display-off period 250, respectively. During the rear part 262 of the first transition period 251, both the source electrode 150 and the VCOM/in-cell sensor electrode 160 are driven with the GND voltage. During the front part 261 thereof, the source electrode 150 is driven with a +VL or −VL voltage (to be explained), and the VCOM/in-cell sensor electrode 160 is driven with a VCOM_display voltage. During the whole first transition period 251, the gate electrode 140 is driven according to a scanning scheme used for driving the gate electrode 140 in the first display-on period 255 and the second display-on period 256. That is, during the first transition period 251, the gate electrode 140 is driven as if the panel were still in a display-on mode.

Figure 4:
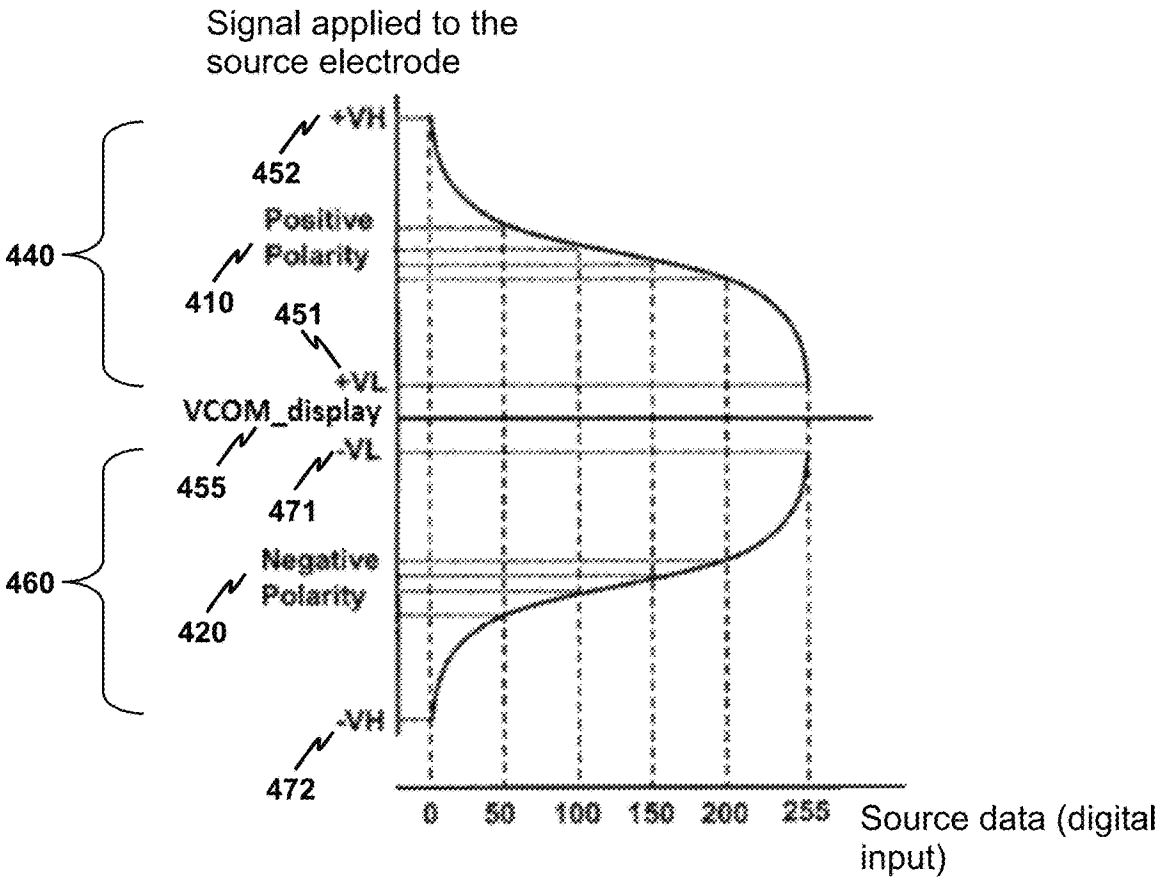
FIG. 4 (Related Art)
FIG. 4 depicts an arrangement for driving the source electrode for a normally black panel according to input digital data during a display-on period.

The +VL voltage, the −VL voltage and the VCOM_display voltage are illustrated with the aid of FIG. 4, which depicts an arrangement for driving the source electrode 150 according to input digital data during display-on (i.e. during the first display-on period 255 or the second display-on period 256). Specifically, the arrangement shown in FIG. 4 is for a normally black panel, which displays with relatively dark brightness when the voltage difference between the source electrode and the VCOM electrode is relatively small. (The case for a normally white panel will be addressed later.) The VCOM_display voltage (labeled as 455 in FIG. 4) is a voltage used to drive the VCOM/in-cell sensor electrode 160 during display-on. Since the LC 110 is required to be driven by a signal without a DC component, the driving arrangement includes a positive-polarity part 410 and a negative-polarity part 420 that is symmetrical to the positive-polarity part 410 so as to generate an AC signal to drive the source electrode 150. For the positive-polarity part 410, a voltage range 440 bounded by a +VH voltage 452 and the +VL voltage (labeled as 451 in FIG. 4) includes all pre-defined allowable positive voltages generated by a positive source buffer and supplied to the source electrode 150 during display-on. Similarly, for the negative-polarity part 420, another voltage range 460 bounded by a −VH voltage 472 and the −VL voltage (labeled as 471 in FIG. 4) includes all pre-defined allowable negative voltages generated by a negative source buffer and supplied to the source electrode 150 during display-on. Hence, the +VL voltage 451 and the −VL voltage 471 are a positive voltage and a negative voltage, respectively, closest to the VCOM_display voltage 455 among all the pre-defined allowable voltages (the two voltage ranges 440, 460). When it is required to keep the panel black, the +VL voltage 451 or the −VL voltage 471 is supplied, or both these voltages 451, 471 are alternately supplied, to the source electrode 150. For the normally white panel, which displays with greater brightness when the voltage difference between the source electrode and the VCOM electrode is smaller, the +VL voltage and the −VL voltage become a positive voltage and a negative voltage, respectively, farthest to the VCOM_display voltage among all the pre-defined allowable voltages. To keep the panel white, the +VL voltage or the −VL voltage is supplied, or both these voltages are alternately supplied, to the source electrode.

Consider the second transition period 252 shown in FIG. 2. The second transition period 252 is divided into a front part 271 and a rear part 272. The front part 271 and the rear part 272 of the second transition period 252 are adjacent to the display-off period 250 and the second display-on period 256, respectively. During the front part 271 of the second transition period 252, the source electrode 150 and the VCOM/in-cell sensor electrode 160 are driven with the GND voltage. During the rear part 272 thereof, the source electrode 150 is driven with the +VL or −VL voltage, and the VCOM/in-cell sensor electrode 160 is driven with the VCOM_display voltage. During the whole second transition period 252, the gate electrode 140 is driven according to the above-mentioned scanning scheme.

Note that FIGS. 2 and 3 show the same signal waveforms for the first transition period 251 and the second transition period 252. Hence, regardless of whether or not touch sensing is performed during the display-off period 250, the driving scheme used in the first transition period 251 (or the second transition period 252) remains the same.

In general, the first transition period 251 and the second transition period 252 are substantially shorter than the display-off period 250, and are preferably kept short. A duration of one or more, or just a few of, image frames may be sufficient as a length used for either part of a transition period (namely, the front part 261 of the first transition period 251, the rear part 262 thereof, the front part 271 of the second transition period 252, and the rear part 272 thereof).

A third aspect of the present invention is to provide an apparatus for driving the TFT LCD panel. The apparatus comprises one or more drivers configured to drive the gate electrode 140, the source electrode 150 and the VCOM electrode 160 (or the VCOM/in-cell sensor electrode 160) by a driving scheme according to any of the embodiments disclosed in the first or second aspect of the present invention. Those skilled in the art may arrange the one or more drivers in the apparatus to drive these electrodes 140, 150, 160 according to different practical situations. As an example, also mentioned in U.S. patent application Ser. No. 14/807,894, the one or more drivers are arranged to be a plurality of gate drivers for driving the gate electrodes of the TFTs of all the cells in the panel, a plurality of source drivers for driving the source electrodes of the TFTs, and a VCOM driver for driving the VCOM electrodes.

In practical implementation, the embodiments of the apparatus as disclosed above may be fabricated as an integrated device or an integrated circuit.

In industrial applications, the apparatus can be made as a display driver having a function of touch sensing, or an integrated controller having functionalities of controlling image display and detecting on-screen touch. The apparatus may also be integrated in an interactive display system, a smartphone, or a tablet computer.

The present invention may be embodied in other specific forms without departing from the spirit or essential characteristics thereof. The present embodiment is therefore to be considered in all respects as illustrative and not restrictive. The scope of the invention is indicated by the appended claims rather than by the foregoing description, and all changes that come within the meaning and range of equivalency of the claims are therefore intended to be embraced therein.

What is claimed is:

1. A method for driving a thin film transistor (TFT) liquid crystal display (LCD) panel during a display-off period, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, the method comprising the steps of:

(a) when the display-off period begins, driving the gate electrode, the source electrode and the VCOM electrode to configure the panel to be black for a first pre-determined duration unless such configuring of the panel is prematurely terminated by a termination of the display-off period;

(b) when the first pre-determined duration expires, driving the gate electrode with a VGH voltage to turn on the TFT for a second pre-determined duration;

(c) over the second pre-determined duration within which the gate electrode is driven with the VGH voltage in the step (b), driving the source electrode and the VCOM electrode with the GND voltage, whereby charge accumulated on the LC is released;

(d) when the second pre-determined duration expires, driving the gate electrode, the source electrode and the VCOM electrode to configure the panel to be black again for the first pre-determined duration unless such configuring of the panel is prematurely terminated by the termination of the display-off period; and (e) repeating the steps (b), (c) and (d) until the display-off period expires or the termination of the display-off period occurs.

2. The method of claim 1, wherein the second pre-determined duration is selected to be a duration of one image frame.

3. The method of claim 1, further comprising:

driving the source electrode and the VCOM electrode with the GND voltage during the display-off period.

4. The method of claim 1, wherein the panel supports touch sensing so that the VCOM electrode is also an in-cell sensor electrode, and wherein the method further comprises:

in the steps (a) and (d), driving the gate electrode, the source electrode and the in-cell sensor electrode to further configure the panel to perform touch sensing while maintaining the panel to be black.

5. The method of claim 4, wherein in the steps (a) and (d), the gate electrode is driven with a VGL voltage to turn off the TFT, and the in-cell sensor electrode is driven with a toggling waveform to enable touch sensing while maintaining the panel to be black.

6. The method of claim 4, wherein the termination of the display-off period is triggered when a touch on the panel is sensed.

7. A method for driving a thin film transistor (TFT) liquid crystal display (LCD) panel during a time period between an end of a first display-on period and a beginning of a second display-on period, the first and second display-on periods being successive display-on periods with a display-off period in between, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, the method comprising:

driving the panel during the display-off period according to the method of claim 1;

in driving the panel during a first transition period bounded by the end of the first display-on period and a beginning of the display-off period, driving the source electrode and the VCOM electrode with the GND voltage during a rear part of the first transition period, wherein the first transition period is divided into a front part and the rear part, the front part of the first transition period being adjacent to the first display-on period, the rear part of the first transition period being adjacent to the display-off period;

in driving the panel during a second transition period bounded by an end of the display-off period and the beginning of the second display-on period, driving the source electrode and the VCOM electrode with the GND voltage during a front part of the second transition period, wherein the second transition period is divided into the front part and a rear part, the front part of the second transition period being adjacent to the display-off period, the rear part of the second transition period being adjacent to the second display-on period; and during the first and second transition periods, driving the gate electrode according to a scanning scheme used for driving the gate electrode in the first and second display-on periods.

8. The method of claim 7, wherein:

the rear part of the first transition period is selected to have a duration of one or more image frames; and the front part of the second transition period is selected to have a duration of one or more image frames.

9. The method of claim 7, further comprising:

during the front part of the first transition period, driving the source electrode with a +VL voltage or with a −VL voltage, and driving the VCOM electrode with a VCOM_display voltage, wherein:

the VCOM_display voltage is a voltage used to drive the VCOM electrode during the first and second display-on periods;

when the panel is a normally black panel, the +VL voltage and the −VL voltage are a positive voltage and a negative voltage, respectively, closest to the VCOM_display voltage among all pre-defined allowable voltages supplied to the source electrode during the first and second display-on periods; and when the panel is a normally white panel, the +VL voltage and the −VL voltage are a positive voltage and a negative voltage, respectively, farthest to the VCOM_display voltage among all the pre-defined allowable voltages supplied to the source electrode during the first and second display-on periods;

and during the rear part of the second transition period, driving the source electrode with the +VL or −VL voltage, and the VCOM electrode with the VCOM_display voltage.

10. The method of claim 9, wherein:

the front part of the first transition period is selected to have a duration of one or more image frames; and the rear part of the second transition period is selected to have a duration of one or more image frames.

11. A method for driving a thin film transistor (TFT) liquid crystal display (LCD) panel during a time period between an end of a first display-on period and a beginning of a second display-on period, the first and second display-on periods being successive display-on periods with a display-off period in between, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, the panel supporting touch sensing so that the VCOM electrode is also an in-cell sensor electrode, the method comprising:

driving the panel during the display-off period according to the method of claim 4;

in driving the panel during a first transition period bounded by the end of the first display-on period and a beginning of the display-off period, driving the source electrode and the VCOM electrode with the GND voltage during a rear part of the first transition period, wherein the first transition period is divided into a front part and the rear part, the front part of the first transition period being adjacent to the first display-on period, the rear part of the first transition period being adjacent to the display-off period;

in driving the panel during a second transition period bounded by an end of the display-off period and the beginning of the second display-on period, driving the source electrode and the VCOM electrode with the GND voltage during a front part of the second transition period, wherein the second transition period is divided into the front part and a rear part, the front part of the second transition period being adjacent to the display-off period, the rear part of the second transition period being adjacent to the second display-on period; and during the first and second transition periods, driving the gate electrode according to a scanning scheme used for driving the gate electrode in the first and second display-on periods.

12. The method of claim 11, wherein the termination of the display-off period is triggered when a touch on the panel is sensed.

13. The method of claim 11, wherein:

the rear part of the first transition period is selected to have a duration of one or more image frames; and the front part of the second transition period is selected to have a duration of one or more image frames.

14. An apparatus for driving a thin film transistor (TFT) liquid crystal display (LCD) panel, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, wherein the apparatus comprises:

one or more drivers configured to drive the gate electrode, the source electrode and the VCOM electrode during a display-off period according to the method of claim 1.

15. An apparatus for driving a thin film transistor (TFT) liquid crystal display (LCD) panel, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, wherein the apparatus comprises:

one or more drivers configured to drive the gate electrode, the source electrode and the VCOM electrode during a display-off period according to the method of claim 2.

16. An apparatus for driving a thin film transistor (TFT) liquid crystal display (LCD) panel, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, the panel supporting touch sensing so that the VCOM electrode is also an in-cell sensor electrode, wherein the apparatus comprises:

one or more drivers configured to drive the gate electrode, the source electrode and the VCOM electrode during a display-off period according to the method of claim 4.

17. An apparatus for driving a thin film transistor (TFT) liquid crystal display (LCD) panel, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, the panel supporting touch sensing so that the VCOM electrode is also an in-cell sensor electrode, wherein the apparatus comprises:

one or more drivers configured to drive the gate electrode, the source electrode and the VCOM electrode during a display-off period according to the method of claim 5.

18. An apparatus for driving a thin film transistor (TFT) liquid crystal display (LCD) panel, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, wherein the apparatus comprises:

one or more drivers configured to drive the gate electrode, the source electrode and the VCOM electrode during a time period between an end of a first display-on period and a beginning of a second display-on period according to the method of claim 7, where the first and second display-on periods are successive display-on periods with a display-off period in between.

19. An apparatus for driving a thin film transistor (TFT) liquid crystal display (LCD) panel, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, the panel supporting touch sensing so that the VCOM electrode is also an in-cell sensor electrode, wherein the apparatus comprises:

one or more drivers configured to drive the gate electrode, the source electrode and the VCOM electrode during a time period between an end of a first display-on period and a beginning of a second display-on period according to the method of claim 11, where the first and second display-on periods are successive display-on periods with a display-off period in between.

20. An apparatus for driving a thin film transistor (TFT) liquid crystal display (LCD) panel, the panel comprising plural cells, each of the cells having a TFT for driving a liquid crystal (LC), a gate electrode coupled to a gate of the TFT, a source electrode coupled to one end of the LC via the TFT, and a VCOM electrode coupled to another end of the LC, the panel supporting touch sensing so that the VCOM electrode is also an in-cell sensor electrode, wherein the apparatus comprises:

one or more drivers configured to drive the gate electrode, the source electrode and the VCOM electrode during a time period between an end of a first display-on period and a beginning of a second display-on period according to the method of claim 13, where the first and second display-on periods are successive display-on periods with a display-off period in between.

* * * * *